US011107437B2

(12) United States Patent
Rao

(10) Patent No.: US 11,107,437 B2
(45) Date of Patent: Aug. 31, 2021

(54) TIMING CONTROLLER, DISPLAY DRIVING METHOD AND DISPLAY DEVICE

(71) Applicant: BOE TECHNOLOGY GROUP CO., LTD., Beijing (CN)

(72) Inventor: Tianmin Rao, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/698,258

(22) Filed: Nov. 27, 2019

(65) Prior Publication Data

US 2020/0312270 A1 Oct. 1, 2020

(30) Foreign Application Priority Data

Mar. 25, 2019 (CN) ..... 201910228874.5

(51) Int. Cl.
*G09G 3/36* (2006.01)
*G09G 5/00* (2006.01)

(52) U.S. Cl.
CPC ..... *G09G 5/006* (2013.01); *G09G 2310/08* (2013.01); *G09G 2340/0407* (2013.01)

(58) Field of Classification Search
CPC ..... G09G 2310/08
See application file for complete search history.

(56) References Cited

U.S. PATENT DOCUMENTS

2010/0225620 A1* 9/2010 Lee ..... G09G 3/20 345/204
2017/0193954 A1* 7/2017 Wu ..... G09G 3/3677
2018/0061352 A1* 3/2018 Kim ..... G09G 3/3648

FOREIGN PATENT DOCUMENTS

WO WO 2018126720 A1 * 7/2018

* cited by examiner

*Primary Examiner* — Roy P Rabindranath
(74) *Attorney, Agent, or Firm* — Nath, Goldberg & Meyer; Joshua B. Goldberg

(57) ABSTRACT

A timing controller, a display driving method, and a display device are provided. The timing controller includes a signal acquisition module configured to acquire a target-frequency control signal and send the target-frequency control signal to a clock module and an output module; a clock module configured to generate a corresponding clock signal according to the target-frequency control signal, and send the clock signal to the output module; and an output module configured to output a driving signal of the target frequency to a driving circuit according to the clock signal, such that the driving circuit drives a display panel to display according to the target frequency.

17 Claims, 4 Drawing Sheets

TIMING CONTROLLER, DISPLAY DRIVING METHOD AND DISPLAY DEVICE

CROSS-REFERENCE TO RELATED APPLICATIONS

The present application claims the priority of the Chinese Patent Application No. 201910228874.5, filed on Mar. 25, 2019, the contents of which are incorporated herein in their entirety by reference.

TECHNICAL FIELD

The present application relates to the field of display technology, and more particularly to a timing controller, a display driving method, and a display device.

BACKGROUND

A display device generally includes a display panel and a driving circuit for driving the display panel. The driving circuit includes a timing controller (TCON), a gate driving circuit, and a source driving circuit. The TCON can output a control signal at a fixed frequency to the gate driving circuit, such that the gate driving circuit can scan pixel units of the display panel according to the frequency of the control signal.

SUMMARY

The present disclosure provides a timing controller, including: a signal acquisition module, a clock module and an output module, the signal acquisition module is configured to acquire a target-frequency control signal for a target frequency and send the target-frequency control signal to the clock module and the output module; the clock module is configured to generate a corresponding clock signal according to the target-frequency control signal, and send the clock signal to the output module; and the output module is configured to output a driving signal of the target frequency to a driving circuit according to the clock signal, such that the driving circuit drives a display panel to display according to the target frequency.

In an embodiment, the driving signal includes a field synchronization signal and a line synchronization signal, and the output module includes a driving unit, a field synchronization unit and a row synchronization unit, the driving unit is configured to generate a corresponding timing driving signal according to the target-frequency control signal, and send the timing driving signal to the field synchronization unit and the row synchronization unit; the field synchronization unit is configured to generate a field synchronization signal of the target frequency according to the clock signal and the timing driving signal, and output the field synchronization signal to the driving circuit; and the row synchronizing unit is configured to generate a row synchronization signal of the target frequency according to the clock signal and the timing driving signal, and output the row synchronization signal to the driving circuit.

In an embodiment, the timing controller further includes a low voltage differential signaling (LVDS) receiving unit configured to output a data signal corresponding to the target frequency to the output module, to control the output module to generate a driving signal of the target frequency.

In an embodiment, the clock module includes a Time Averaged Frequency Direct Period Generator (TAF-DPS) clock generator.

In an embodiment, the signal acquisition module includes a decision input unit and an I2C bus; the decision input unit is configured to receive a tag corresponding to a display state, and send the target-frequency control signal to the I2C bus according to the target frequency indicated by the tag; and the I2C bus is configured to output the target-frequency control signal to the clock module and the output module.

In an embodiment, the target frequency indicated by the tag is changed by the display state corresponding to a refresh rate or a resolution.

In an embodiment, the target frequency includes any one of 60 Hz, 120 Hz, and 144 Hz.

The present disclosure further provides a display driving method, including steps of: acquiring, by a signal acquisition module, a target-frequency control signal for a target frequency and sending the target-frequency control signal to a clock module and an output module; generating, by the clock module, a corresponding clock signal according to the target-frequency control signal, and sending the clock signal to the output module; and outputting, by the output module, a driving signal of the target frequency to a driving circuit according to the clock signal such that the driving circuit drives a display panel to display according to the target frequency.

In an embodiment, the driving signal includes a field synchronization signal and a row synchronization signal, and the outputting, by the output module, the driving signal of the target frequency to the driving circuit according to the clock signal such that the driving circuit drives the display panel to display according to the target frequency includes: generating, by a driving unit of the output module, a corresponding timing driving signal according to the target-frequency control signal, and sending the timing driving signal to a field synchronization unit and a row synchronization unit of the output module; generating, by the field synchronization unit of the output module, a field synchronization signal of the target frequency according to the clock signal and the timing driving signal, and outputting the field synchronization signal to the driving circuit; and generating, by the row synchronizing unit of the output module, a row synchronization signal of the target frequency according to the clock signal and the timing driving signal, and outputting the row synchronization signal to the driving circuit.

In an embodiment, the display driving method further includes: outputting, by a low voltage differential signaling (LVDS) receiving unit, a data signal corresponding to the target frequency to the output module, to control the output module to generate a driving signal of the target frequency.

In an embodiment, the acquiring, by the signal acquisition module, the target-frequency control signal for the target frequency and sending the target-frequency control signal to the clock module and the output module includes: receiving, by a decision input unit of the signal acquisition module, a tag corresponding to a display state, and sending the target-frequency control signal to an I2C bus of the signal acquisition module according to the target frequency indicated by the tag; and outputting, by the I2C bus of the signal acquisition module, the target-frequency control signal to the clock module and the output module.

In an embodiment, the target frequency indicated by the tag is changed by the display state corresponding to a refresh rate or a resolution.

The present disclosure further provides a display device, including a display panel, a driving circuit, and the timing controller above.

In an embodiment, the driving circuit includes a gate driving circuit connected to a field synchronization unit of the output module of the timing controller and a source driving circuit connected to a row synchronization unit of the output module of the timing controller.

In an embodiment, display states of the display device includes a dynamic display state and a static display state, and a target frequency corresponding to the dynamic display state is greater than a target frequency corresponding to the static display state.

In an embodiment, a tag indicating a target frequency is sent to the signal acquisition module in the display device based on a display state of the display device at a refresh rate or resolution.

DETAILED DESCRIPTION

For better understanding of a technical solution of the present disclosure by those skilled in the art, the present disclosure will be described in detail below in conjunction with the drawings and specific embodiments.

In some cases, a timing controller of a display device at least has the following problems: a frequency of a control signal output by the timing controller is generally predetermined, and the frequency of the control signal is a frequency at which the display panel refreshes an image (also referred to as a frame rate of the display device). That is, the current TCON generally supports display at a certain frequency, and different chips are required to be designed to adapt to products of different frequencies.

Figure 1:
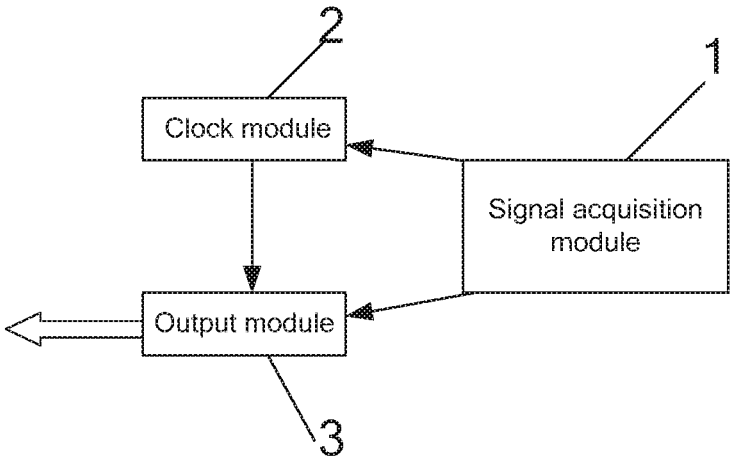
FIG. 1 is a schematic diagram illustrating a structure of a timing controller according to an embodiment of the present disclosure.

In this regard, an embodiment of the present disclosure provides a timing controller, as shown in FIG. 1, and the timing controller includes a signal acquisition module 1, a clock module 2, and an output module 3. The signal acquisition module 1 is configured to acquire a target-frequency control signal for a target frequency, and send the target-frequency control signal to the clock module 2 and the output module 3; the clock module 2 is configured to generate a corresponding clock signal based on the target-frequency control signal, and send the clock signal to the output module 3; the output module 3 is configured to output a driving signal at the target frequency to a driving circuit 61 according to the clock signal, such that the driving circuit 61 drives a display panel 5 to display according to the target frequency.

The signal acquisition module 1 and the clock module 2 are included in the timing controller of an embodiment of the present disclosure, the signal acquisition module 1 acquires a control signal, and notifies the timing controller to generate timing driving signals corresponding to requirements for different resolutions/refresh rates; the clock module 2 may respond dynamically, i.e., generate corresponding clock signals for different resolutions/refresh rates. Therefore, the timing controller can output different timing signals to a liquid crystal display (LCD) panel dynamically to meet display requirements for different resolutions or refresh rates, and can also output timings for different refresh rates dynamically to achieve fast switching between a high refresh rate and a low refresh rate.

Figure 2:
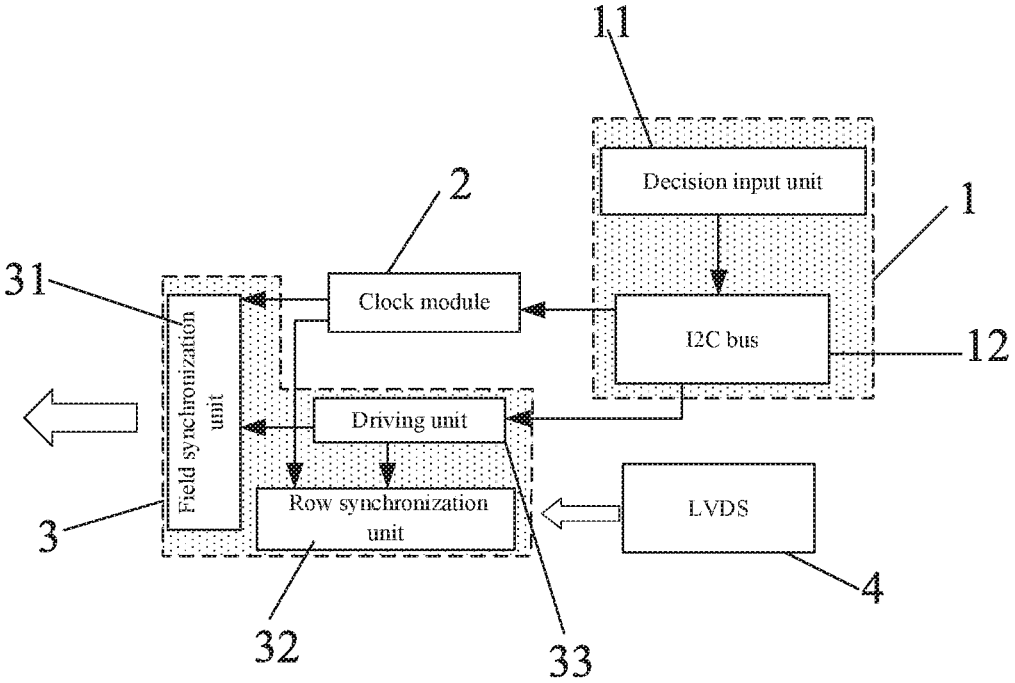
FIG. 2 is a schematic diagram illustrating a structure of a timing controller according to an embodiment of the present disclosure.

An embodiment of the present disclosure provides a timing controller, as shown in FIG. 2, and the timing controller includes a signal acquisition module 1, a clock module 2, and an output module 3. The clock module 2 includes a Time Averaged Frequency Direct Period Generator (TAF-DPS) clock generator; the signal acquisition module 1 is configured to acquire a target-frequency control signal for a target frequency, and send the target-frequency control signal to the clock module 2 and the output module 3; the clock module 2 is configured to generate a corresponding clock signal according to the target-frequency control signal, and send the clock signal to the output module 3; the output module 3 is configured to output a driving signal at the target frequency to the driving circuit according to the clock signal, such that the driving circuit drives the display panel 5 to display according to the target frequency.

In an embodiment of the present disclosure, after the target-frequency control signal is received by the signal acquisition module 1, the TAF-DPS clock generator generates a corresponding clock signal according to the target-frequency control signal. This clock signal may adjust a current output clock, and in an example, a new clock signal may be obtained through merely a few cycles, to provide a driving signal at the target frequency to the driving circuit. The timing controller can dynamically output different timing signals and support display requirements for multi-resolutions/multi-refresh rates. This configuration is simple, and is suitable for a small-area and low-cost circuit design. It should be noted that, the TAF-DPS clock generator in the present disclosure may be the TAF-DPS clock generator disclosed in the patent No. WO2018126720A1, or may be any other similar TAF clock generator.

In an embodiment, the signal acquisition module 1 includes a decision input unit 11 and an I2C bus 12; the decision input unit 11 is configured to receive a tag corresponding to a display state, and send the target-frequency control signal to the I2C bus 12 according to the target frequency indicated by the tag; the I2C bus 12 is configured to input the target-frequency control signal to the clock module 2 and the output module 3.

Figure 3:
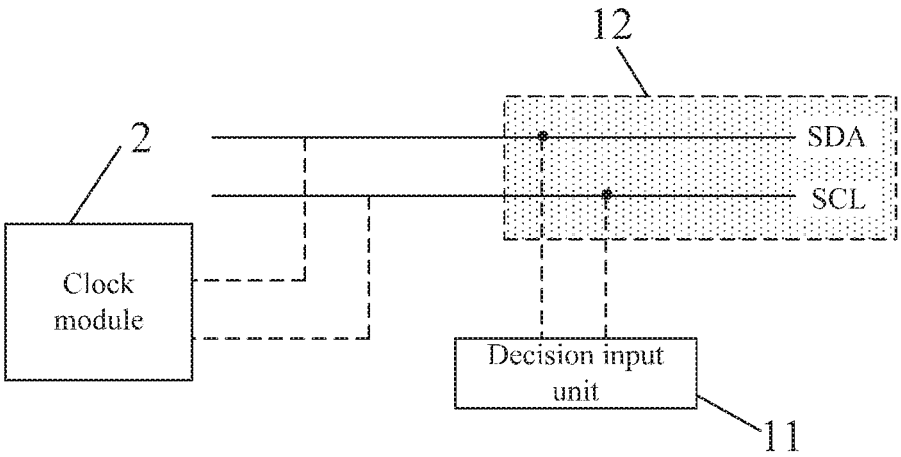
FIG. 3 is a schematic diagram illustrating a part of a structure of a timing controller according to an embodiment of the present disclosure.

As shown in FIG. 3, in an embodiment of the present disclosure, data interaction with the decision input unit 11 is performed through the I2C bus 12. Through the I2C bus 12, decision signals of the decision input unit 11 for multi-resolutions/multi-refresh rates are input to the clock module 2 (such as, a TAF clock generator) to control a current timing dynamically. For example, when the target-frequency control signal input by the decision input unit 11 corresponds to a display state at a high refresh rate, the I2C bus 12 may send it to the TAF clock generator.

In an embodiment, the target frequency includes any of 60 Hz, 120 Hz, and 144 Hz.

There may be requirements for multiple resolutions and/or multiple refresh rates in a display process, and combinations of target frequencies and resolutions in embodiments of the present disclosure may include 480×320/60 Hz, 480×320/120 Hz, 1200×600/60 Hz, 1920×1080/60 Hz, 1920×1080/144 Hz and so on.

In an embodiment, the timing controller further includes a low voltage differential signaling (LVDS) receiving unit 4 configured to output a data signal corresponding to the target frequency to the output module 3, to control the output module 3 to generate a driving signal at the target frequency.

The LVDS receiving unit 4 in an embodiment of the present disclosure is configured to output a data stream corresponding to current requirements to the output module 3, to control the output module 3 to generate a driving signal at the target frequency, such that the TCON timing controller generates a driving signal as required currently.

In an embodiment, the driving signal may include a field synchronization signal and a row synchronization signal, the output module 3 includes a driving unit 33, a field synchronization unit 31, and a row synchronization unit 32. Specifically, the driving unit 33 is configured to generate a corresponding timing driving signal according to the target-frequency control signal, and send the timing driving signal to the field synchronization unit 31 and the row synchronization unit 32; the field synchronization unit 31 is configured to generate the field synchronization signal of the target frequency according to the clock signal and the timing driving signal, and output the field synchronization signal to the driving circuit; and the row synchronizing unit 32 is configured to generate a row synchronization signal of the target frequency according to the clock signal and the timing driving signal, and output the row synchronization signal to the driving circuit 61.

Figure 5:
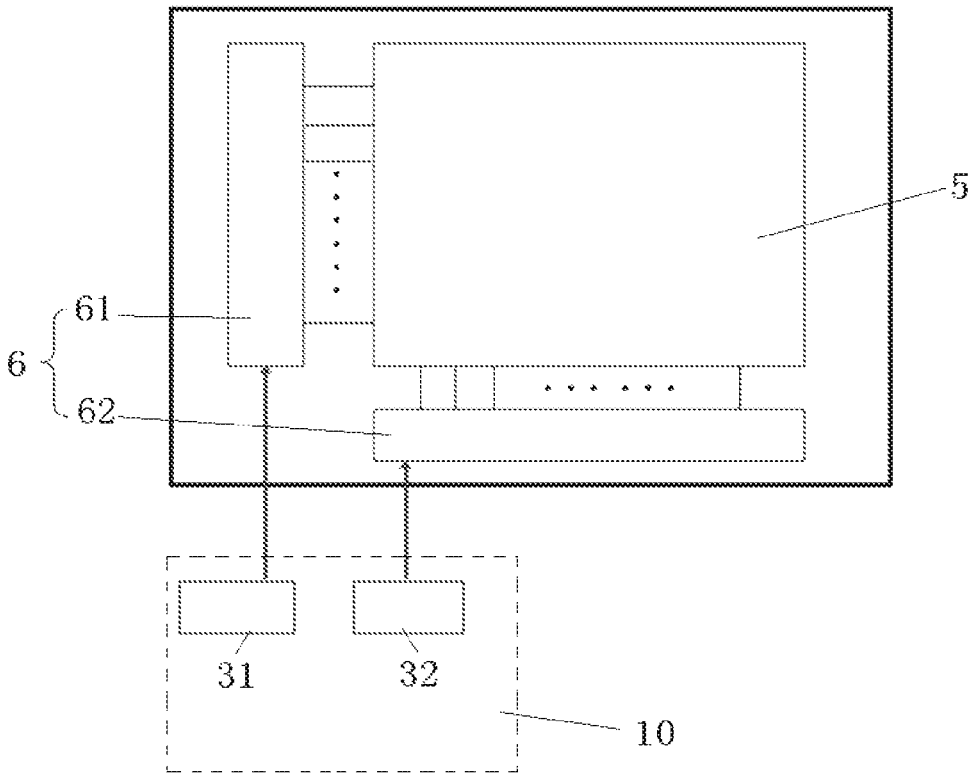
FIG. 5 is a schematic diagram illustrating a structure of a display device according to an embodiment of the present disclosure.
Figure 6:
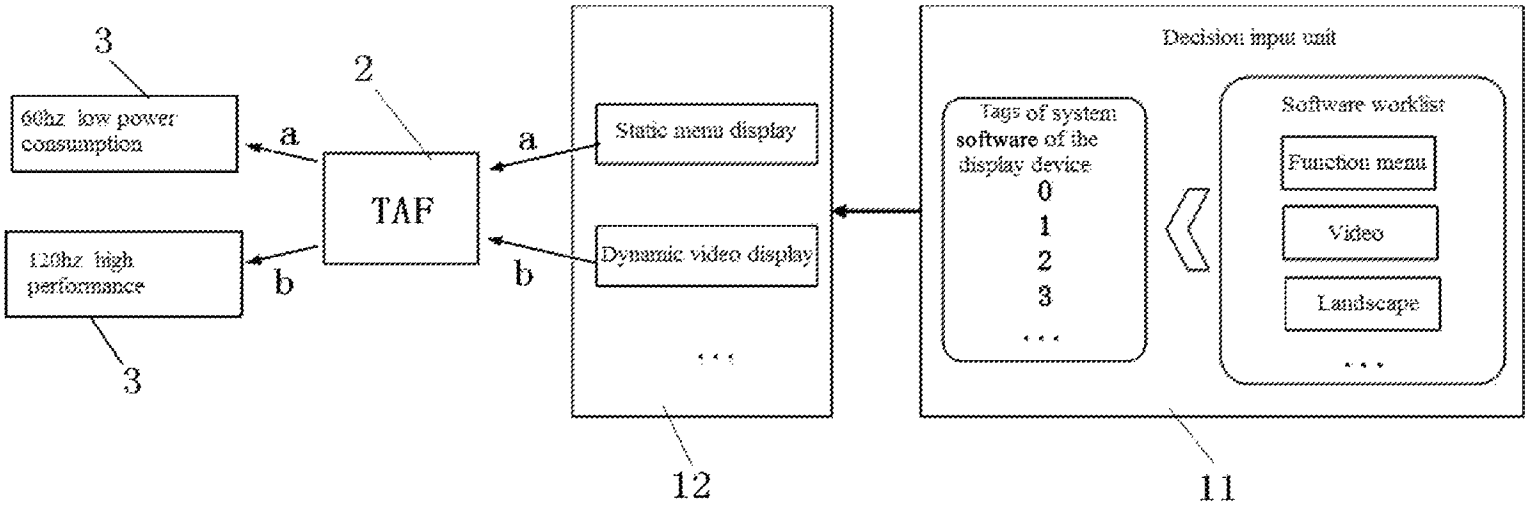
FIG. 6 is a schematic diagram illustrating an application scenario of a display device according to an embodiment of the present disclosure.

As shown in FIG. 5, the field synchronization unit 31 is configured to be connected to a gate driving circuit 61 (gate driver) of a display panel, such as an LCD, and the row synchronization unit 32 is configured to be connected to a source driving circuit 62 (source driver) of the LCD; that is, the gate (column) driver and the source (row) driver of the LCD receive signals from the output module 3 for display driving, to satisfy display requirements for different resolutions/refresh rates.

In the present disclosure, the decision input unit 11 and the I2C bus 12 are introduced to obtain control signals and to notify the clock module 2 to generate timing driving signals corresponding to requirements for different resolutions or refresh rates. In an embodiment of the present disclosure, a TAF-DPS clock generator is utilized to generate timing driving signals and clock signals for different resolutions/refresh rates. The control signal acquired by the signal acquisition module 1 may be from an upper software interface or a sensor within the display device.

The timing controller according to an embodiment of the present disclosure can be applied to display panels of different resolutions, and can be applied to testing and standardization verification. Further, for a same panel, a dynamic driving may be performed to obtain display of different refresh rates within a physically allowable range of the display panel, such that the display panel may display at a high refresh rate when required, and return to a normal refresh rate in a normal scenario to reduce power consumption.

Figure 4:
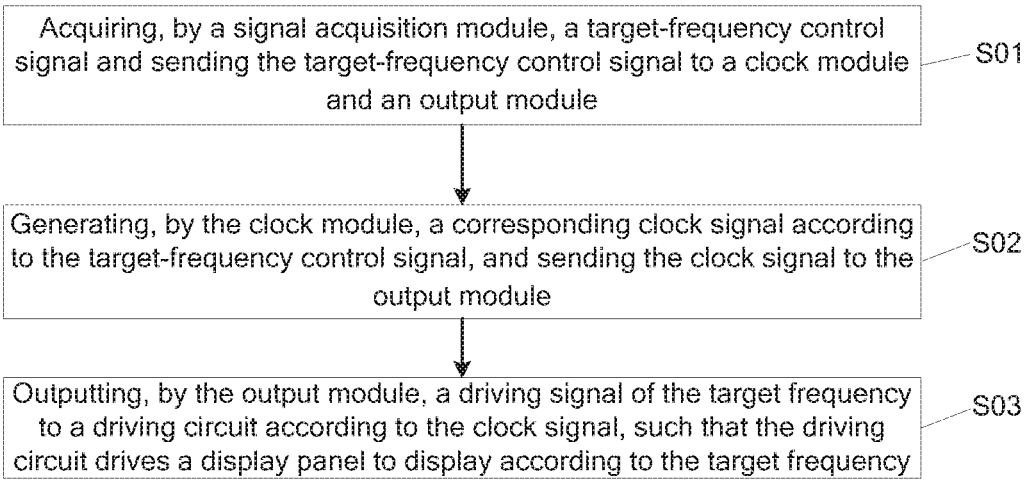
FIG. 4 is a flow chart illustrating a display driving method according to an embodiment of the present disclosure.

An embodiment of the present disclosure provides a display driving method. As shown in FIG. 4, the display driving method includes: steps S01-S03.

At step S01, a signal acquisition module acquires a target-frequency control signal for a target frequency and sends the target-frequency control signal to a clock module and an output module.

At step S02, the clock module generates a corresponding clock signal according to the target-frequency control signal, and sends the clock signal to the output module.

At step S03, an output module outputs a driving signal at the target frequency to a driving circuit according to the clock signal, such that the driving circuit drives a display panel to display according to the target frequency.

In an embodiment, the driving signal includes a field synchronization signal and a row synchronization signal, and the step S03 may include: generating, by a driving unit of the output module, a corresponding timing driving signal according to the target-frequency control signal, and sending the timing driving signal to a field synchronization unit and a row synchronization unit of the output module; generating, by the field synchronization unit of the output module, a field synchronization signal of the target frequency according to the clock signal and the timing driving signal, and outputting the field synchronization signal to the driving circuit; and generating, by the row synchronizing unit of the output module, a row synchronization signal of the target frequency according to the clock signal and the timing driving signal, and outputting the row synchronization signal to the driving circuit. In an embodiment, the display driving method further includes: outputting, by a low voltage differential signaling (LVDS) receiving unit, a data signal corresponding to the target frequency to the output module, to control the output module to generate a driving signal of the target frequency.

In an embodiment, the step S01 may include: receiving, by a decision input unit of the signal acquisition module, a tag corresponding to a display state, and sending the target-frequency control signal to an I2C bus of the signal acquisition module according to the target frequency indicated by the tag; and outputting, by the I2C bus of the signal acquisition module, the target-frequency control signal to the clock module and the output module.

In an embodiment, the tags for display states of different refresh rates or different resolutions indicate different target frequencies.

An embodiment of the present disclosure provides a display device, as shown in FIG. 4, and the display device includes a display panel 5, a driving circuit 61, and the timing controller 10 of the above embodiments.

In an embodiment, the driving circuit 6 includes a gate driving circuit 61 and a source driving circuit 62. The field synchronization unit 31 is connected to the gate driving circuit 61, and the row synchronization unit 32 is connected to the source driving circuit 62.

As shown in FIG. 5, the field synchronization unit 31 is configured to be connected to a gate driving circuit 61 (gate driver) of the display panel 5, and the row synchronization unit 32 is configured to be connected to the source driving circuit 62 (source driver). That is, the gate (column) driver and the source (row) driver of the display panel 5 receive signals from the output module 3 for display driving according to display requirements for different resolutions/refresh rates. Thereby, a dynamic switching between different refresh rates may be achieved.

In an embodiment, the display states of the display device include a dynamic display state and a static display state, and a target frequency corresponding to the dynamic display state is greater than a target frequency corresponding to the static display state.

In an embodiment, tags indicating different target frequencies are sent to the signal acquisition module in the display device for display states of different refresh rates or different resolutions.

Specifically, as shown in FIG. 5, the decision input unit 11 may adjust a current display mode according to different display states. For example, the display device may be in a static menu display (a) state or a dynamic video display (b) state. Generally, when in the (a) state, a screen of the display panel would in a stationary state for a relative long time, thus utilizing a lower refresh rate would not affect the display effect, and is beneficial to reduce the power consumption of the display panel; while in the (b) state, the screen of the display panel often has more dynamic details, and utilizing a high refresh rate in this case would provide the user with a better display effect. For example, at a refresh rate of 120 Hz, a fine dynamic display effect can be achieved.

In practical applications, some display contents (such as, landscape, portrait, etc.) change slowly over time, and can be supported by a display mode of a low refresh rate to achieve low power consumption; while some display contents (such as, sports events, movie special effects scenes, etc.) change relatively fast over time, and can be supported by a display mode of a high refresh rate to ensure a better display effect (high performance).

More specifically, the display states of the display device, such as a function menu display, a video display, a static display, etc., may be indicated in tags of system software of the display device, which may serve as a calling indicator indicating a current system state/parameter. A tag acquisition program may read the tag and send it to the decision input unit 11. Accordingly, the decision input unit 11 sends a suitable target-frequency control signal (e.g., a state control word) to the clock module 2 through the I2C bus 12, to enable a dynamic support for different resolutions/refresh rates. In the present disclosure, an adaptive dynamic adjustment based on the display state can be realized, reducing a cumbersome user control, and providing a convenient and efficient user experience.

The display device in an embodiment of the present disclosure may be any product or component with a display function such as a liquid crystal display panel, an electronic paper, a mobile phone, a tablet computer, a television, a display, a notebook computer, a digital photo frame, a navigator.

The modules, units, and method steps described in the disclosure can be implemented in software, firmware, hardware, and suitable combinations thereof. The software program may be executable instructions stored on a storage medium (such as a ROM/RAM, a magnetic disk, an optical disk, etc.) and the executable instructions, when executed by a processor, may cause the modules/units in the above embodiments to be implemented, or the display driving method disclosed in the embodiments of the present disclosure to be performed by a device (e.g., a display device) or a processor.

In an embodiment, the decision input unit in the signal acquisition module may be a software program, the I2C bus in the signal acquisition module is a bus for transmitting data, the clock module may be a clock circuit in hardware, and the output module may be a hardware circuit.

For example, units involved in the embodiments of the present disclosure, such as the decision input unit, the field synchronization unit, the row synchronization unit, and the drive unit, may be realized by means of software or hardware. The described units or modules may also be provided in a processor, for example, each of the above units may be a software program provided in a computer or a mobile intelligent device, or a separate hardware device.

It is to be understood that the above embodiments and implementations are merely exemplary embodiments and implementations employed to illustrate the principle of the present disclosure, but the disclosure is not limited thereto. For those skilled in the art, various modifications and improvements are possible without departing from the spirit and scope of the disclosure, and such modifications and improvements are regarded as within the scope of the disclosure.

What is claimed is:

1. A timing controller, comprising a signal acquisition module, a clock module and an output module, wherein the signal acquisition module is configured to acquire a target-frequency control signal for a target frequency and send the target-frequency control signal to the clock module and the output module;

the clock module is configured to generate a corresponding clock signal according to the target-frequency control signal, and send the clock signal to the output module; and the output module is configured to output a driving signal of the target frequency to a driving circuit according to the clock signal, such that the driving circuit drives a display panel to display according to the target frequency;

wherein the driving signal comprises a field synchronization signal and a line synchronization signal, and the output module comprises a driving unit, a field synchronization unit and a row synchronization unit, wherein the driving unit is configured to generate corresponding timing driving signal according to the target-frequency control signal, and send the timing driving signal to the field synchronization unit and the row synchronization unit, the field synchronization unit is configured to generate a field synchronization signal of the target frequency according to the clock signal and the timing driving signal, and output the field synchronization signal to the driving circuit; and the row synchronizing unit is configured to generate a row synchronization signal of the target frequency according to the clock signal and the timing driving signal, and output the row synchronization signal to the driving circuit.

2. The timing controller of claim 1, further comprising a low voltage differential signaling (LVDS) receiving unit configured to output a data signal corresponding to the target frequency to the output module, to control the output module to generate a driving signal of the target frequency.

3. The timing controller of claim 1, wherein the clock module comprises a Time Averaged Frequency Direct Period Generator (TAF-DPS) clock generator.

4. The timing controller of claim 1, wherein the signal acquisition module comprises a decision input unit and an I2C bus;

the decision input unit is configured to receive a tag corresponding to a display state and indicating the target frequency, and send the target-frequency control signal to the I2C bus according to the target frequency; and the I2C bus is configured to output the target-frequency control signal to the clock module and the output module.

5. The timing controller of claim 4, wherein the target frequency indicated by the tag is changed based on the display state corresponding to a refresh rate or a resolution.

6. The timing controller of claim 4, wherein the target frequency comprises any one of 60 Hz, 120 Hz and 144 Hz.

7. A display device, comprising a display panel, a driving circuit, and the timing controller of claim 1.

8. The display device of claim 7, further comprising a low voltage differential signaling (LVDS) receiving unit configured to output a data signal corresponding to the target frequency to the output module, to control the output module to generate the driving signal of the target frequency.

9. The display device of claim 7, wherein the clock module comprises a Time Averaged Frequency Direct Period Generator (TAF-DPS) clock generator.

10. The display device of claim 7, wherein the signal acquisition module comprises a decision input unit and an I2C bus;

the decision input unit is configured to receive a tag corresponding to a display state and indicating the target frequency, and send the target-frequency control signal to the I2C bus according to the target frequency; and the I2C bus is configured to output the target-frequency control signal to the clock module and the output module.

11. The display device of claim 7, wherein the driving circuit comprises a gate driving circuit connected to a field synchronization unit of the output module of the timing controller and a source driving circuit connected to a row synchronization unit of the output module of the timing controller.

12. The display device of claim 7, wherein display states of the display device comprise a dynamic display state and a static display state, and a target frequency corresponding to the dynamic display state is greater than a target frequency corresponding to the static display state.

13. The display device of claim 12, wherein a tag indicating a target frequency is sent to the signal acquisition module based on a display state corresponding to a refresh rate or a resolution.

14. A display driving method, comprising steps of:

acquiring, by a signal acquisition module, a target-frequency control signal for a target frequency and sending the target-frequency control signal to a clock module and an output module;

generating, by the clock module, a corresponding clock signal according to the target-frequency control signal, and sending the clock signal to the output module; and outputting, by the output module, a driving signal of the target frequency to a driving circuit according to the clock signal such that the driving circuit drives a display panel to display according to the target frequency;

wherein the driving signal comprises a field synchronization signal and a line synchronization signal, and the outputting, by the output module, the driving signal of the target frequency to the driving circuit according to the clock signal such that the driving circuit drives the display panel to display according to the target frequency comprises:

generating, by a driving unit of the output module, a corresponding timing driving signal according to the target-frequency control signal, and sending the timing driving signal to a field synchronization unit and a row synchronization unit of the output module;

generating, by the field synchronization unit of the output module, a field synchronization signal of the target frequency according to the clock signal and the timing driving signal, and outputting the field synchronization signal to the driving circuit; and generating, by the row synchronizing unit of the output module, a row synchronization signal of the target frequency according to the clock signal and the timing driving signal, and outputting the row synchronization signal to the driving circuit.

15. The display driving method of claim 14, further comprising:

outputting, by a low voltage differential signaling (LVDS) receiving unit, a data signal corresponding to the target frequency to the output module, to control the output module to generate a driving signal of the target frequency.

16. The display driving method of claim 14, wherein the acquiring, by the signal acquisition module, the target-frequency control signal for the target frequency and sending the target-frequency control signal to the clock module and the output module comprises:

receiving, by a decision input unit of the signal acquisition module, a tag corresponding to a display state and indicating the target frequency, and sending the target-frequency control signal to an I2C bus of the signal acquisition module according to the target frequency; and outputting, by the I2C bus of the signal acquisition module, the target-frequency control signal to the clock module and the output module.

17. The display driving method of claim 16, wherein the target frequency indicated by the tag is changed based on the display state corresponding to a refresh rate or a resolution.

* * * * *